US007032767B2

(12) United States Patent
Funck

(10) Patent No.: US 7,032,767 B2
(45) Date of Patent: Apr. 25, 2006

(54) PRESSURIZED CONTAINER FOR STORING PRESSURIZED LIQUID AND/OR GASEOUS MEDIA, CONSISTING OF A PLASTIC CORE CONTAINER WHICH IS REINFORCED WITH FIBRE-REINFORCED PLASTICS AND A METHOD FOR PRODUCING THE SAME

(76) Inventor: Ralph Funck, Finkenstrasse 59, Kaiserslautern (DE), 67661

( * ) Notice: Subject to any disclaimer, the term of this patent is extended or adjusted under 35 U.S.C. 154(b) by 132 days.

(21) Appl. No.: 10/181,839

(22) PCT Filed: Jan. 5, 2001

(86) PCT No.: PCT/DE01/00091

§ 371 (c)(1),
(2), (4) Date: Oct. 9, 2002

(87) PCT Pub. No.: WO01/51844

PCT Pub. Date: Jul. 19, 2001

(65) Prior Publication Data

US 2003/0089723 A1 May 15, 2003

(30) Foreign Application Priority Data

Jan. 10, 2000 (DE) ..... 100 00 705

(51) Int. Cl.
*F17C 1/00* (2006.01)

(52) U.S. Cl. ..... 220/581; 220/582

(58) Field of Classification Search ..... 220/581, 220/582, 586

See application file for complete search history.

(56) References Cited

U.S. PATENT DOCUMENTS

| | | | | | |
|---|---|---|---|---|---|
| 3,540,762 | A | * | 11/1970 | Dunlap | 285/391 |
| 3,907,149 | A | * | 9/1975 | Harmon | 220/590 |
| 3,937,499 | A | * | 2/1976 | Courtot | 285/319 |
| 4,360,116 | A | * | 11/1982 | Humphrey | 220/586 |
| 4,438,858 | A | * | 3/1984 | Grover | 220/590 |
| 4,561,568 | A | * | 12/1985 | Hoffmeister et al. | 222/130 |
| 4,586,735 | A | * | 5/1986 | Innes | 285/354 |
| 4,765,507 | A | | 8/1988 | Yavorsky et al. | |
| 4,993,579 | A | | 2/1991 | Burchett | |
| 5,287,987 | A | * | 2/1994 | Gaiser | 220/589 |
| 5,297,987 | A | * | 3/1994 | Emmons et al. | 454/74 |
| 5,429,845 | A | * | 7/1995 | Newhouse et al. | 428/34.1 |
| 5,443,580 | A | * | 8/1995 | Cotter | 285/179 |
| 5,584,411 | A | * | 12/1996 | Channell et al. | 220/62.19 |
| 6,089,399 | A | * | 7/2000 | Felbaum et al. | 220/582 |
| 6,230,922 | B1 | * | 5/2001 | Rasche et al. | 220/586 |

FOREIGN PATENT DOCUMENTS

| | | | |
|---|---|---|---|
| CN | 1031273 | A | 2/1989 |
| DE | 2152123 | A | 5/1973 |
| EP | 0203631 | A2 | 12/1986 |
| EP | 0810081 | A1 | 12/1997 |
| EP | 0821194 | A2 | 1/1998 |
| EP | 0821194 | A3 | 11/1998 |
| FR | 2301746 | A | 9/1976 |
| WO | WO 97/18418 | A1 | 5/1997 |
| WO | WO 99/27293 | * | 6/1999 |

* cited by examiner

*Primary Examiner*—Joseph C. Merek
(74) *Attorney, Agent, or Firm*—Steven & Showalter LLP

(57) ABSTRACT

A plastic core container is reinforced with a fibre-plastic composite for storing pressurized liquid and/or gaseous media and includes one or more connecting parts located in the neck and/or base and/or cylindrical container part. At least one connecting part is configured to receive a screw-in cylindrical or conical pressure-line feed device. A cylindrical insert is mounted in a connection shank of the plastic core container and has an end collar that envelops or surrounds the end of the connection shank. At least two seals are positioned so that at least one seal lies between the insert and the inner surface of the plastic connecting shank and at least one additional seal lies between the insert and the pressure-line feed device to guarantee a tight and permanent impermeability in the vicinity of the connecting parts, even under extreme, fluctuating thermal and operational stresses.

16 Claims, 1 Drawing Sheet

PRESSURIZED CONTAINER FOR STORING PRESSURIZED LIQUID AND/OR GASEOUS MEDIA, CONSISTING OF A PLASTIC CORE CONTAINER WHICH IS REINFORCED WITH FIBRE-REINFORCED PLASTICS AND A METHOD FOR PRODUCING THE SAME

BACKGROUND OF THE INVENTION

The present invention describes a pressure vessel for storage of liquid and/or gaseous media under an operating pressure above atmospheric pressure, wherein the pressure vessel encloses a hollow space for storage of the medium, and is provided with at least one connection for filling and/or emptying. The invention further relates to a method for manufacturing such a vessel.

Liquid and/or gaseous media are normally transported in pressure vessels that are provided with a suitable construction resistant to leaks, diffusion or permeation of the medium stored, and the mechanical stresses of internal and external pressure respectively, as well as the further stresses of a mechanical, physical and chemical nature during operation.

By appropriate combination of polymers as a matrix with high strength fibres as reinforcement and by selection of a suitable reinforcing construction, customised material properties can be tailored to the component, according what is demanded. Pressure vessels manufactured from fibre plastic composites are equivalent in terms of pressure technology suitability to conventional steel or aluminium vessels, but offer, moreover, crucial advantages such as low weight, increased corrosion resistance and extreme resistance to fatigue.

Pressure vessels manufactured from fibre plastics composites with polymer matrix systems are known, and a large number of patents are in existence.

As an example, reference is made to European patent EP-0.810.081 A1 "Pressure Vessel and Method of Manufacture of Same". This describes how a closed envelope layer that is composed of plastics is enclosed in a fibre winding procedure with a fibre plastics composite. A similar container concept is described in European patent EP0333013 A1 "Pressure Vessels". In this case too, an envelope layer is surrounded with fibres such that the reinforcing shell withstands mechanical stresses.

Other known types of construction are described in patent documents DE 197 51 411 C1, DE 195 261 54 C2, EP 0.821.194.A2 (Mannesmann), EP 0.300.931 (Ullit), EP 0.333.013 A1 (ABB Plast), EP 0.550.951 A1 (Brunswick), EP 0.553.728 A1 (EDO) and WO 94/12396 (NGV Systems). The patent documents describe pressure vessels for gases and/or liquids, composed of plastics base bodies with differently constructed metal connection pieces, that with the exception of EP 0.333.013 A1 show the same patent content, while EP 0.333.013 A1 describes the processing technology of the winding method and respectively the laminate construction, and in particular optimum core geometry for optimum stress ratios in the fibre composite material.

In operation, the technologies described in the patents listed hereinabove have some shortcomings, in particular leaks in the area of the connector and high cost fabrication technologies.

The connector technology described in the EDO patents, for example, resulted in leaks in the area of the connector between the metallic connection piece and the plastics base body after a relatively short time in operation, with the result that the containers has to be taken out of service again. No known use has as yet been made, for example, of the NVG Systems patent, presumably because of the high cost fabrication technology. In the case of the design patented by Brunswick some containers failed during operation because of leaks (source: Powertech Labs/Vancouver).

SUMMARY OF THE INVENTION

The invention described here relates to a pressure vessel of fibre plastics composite for storage of liquid and/or gaseous media under pressure with a plastics core vessel, wherein the object of the invention is to further develop a pressure vessel such that the described disadvantages of the prior art and respectively the operational failures described, are prevented. A fibre plastics composite vessel with low intrinsic weight, high corrosion resistance and greater resistance to fatigue with at the same time long-term sealing will be provided, that withstands mechanical stresses and is inexpensive to manufacture.

The invention is further developed with respect to pressure vessels of fibre plastics composite of the prior art in that in particular a high and long-term sealing capability is ensured at the connection piece even with extremely changeable thermal and mechanical operating stresses.

The object is solved in accordance with one aspect of the invention in the case of the container described in the introduction in that the area of the connector of a plastics core vessel reinforced with fibre plastics composite is provided with a connection piece in the neck and/or base and/or cylindrical part of the vessel, wherein an insert is fitted into the connection piece of the plastics core vessel, which clads the outlet of the connector shank of the plastics core vessel in the manner of a collar.

In one configuration, the insert is provided with an annular groove for a sealing ring beneath the projecting collar of the insert, between the insert and the interior surface of the connector shank of the plastics core vessel. In addition, in one configuration a further annular groove with a sealing ring is provided on the surface of the projecting collar of the insert, which is compressed by pressure hose feed, for example, by a pipeline connector and/or a valve. In a further configuration, the vessel can be provided with an aperture in the cylindrical part for filling and emptying the vessel.

The connection piece is shaped in the manner of a collar with respect to the surface of the plastics core vessel. In order to ensure further specific transfer of force between the fibre plastics composite and connection piece, the connection piece is, for example, provided with notches, raised areas, and/or keyed surfaces in the region where it joins the fibre plastics composite.

For example, and not exclusively, glass fibres, aramid fibres, carbon fibres, polymer fibres, organic fibres, metal fibres and/or other types of fibre can be used as reinforcing fibres in the fibre plastics composite.

With respect to the corresponding method for manufacturing a pressure vessel of fibre plastics composite for storage of liquid and/or gaseous media under an operating pressure above atmospheric pressure, the object upon which the invention is based is solved by means of the following steps:

a) Configuration of the internal surface of the connector shank of the plastics core vessel for receiving the inserts by appropriate shaping in the manufacturing process of the plastics core vessel and/or by subsequent mechanical processing of the internal surface of the connector shank of the plastics core vessel.

b) Fitting of the insert by shrinking the previously heated connector shank of the plastics core vessel in the connector shank, and/or by pressing in and/or by shrinking the insert after previous cooling of the insert into the outlet of the connector shank of the plastics core vessel.

c) Assembly of the connection piece on the external surface of the connector shank of the plastics core vessel, wherein the underside of the collar of the connection piece can be firmly fitted, using suitable fastening techniques, to the external surface of the plastics core vessel d) Reinforcement of the previously assembled plastics core vessel with fibre plastics composite and start of pressure hose feed.

By means of the method according to the invention, vessels can be provided that have the advantageous actions, functions and effects described hereinabove, to which reference is made here and which have been fully taken into account.

The media to be stored can be air, oxygen, nitrogen, carbon dioxide, propane, natural gas, hydrogen or any other technical gases or liquids or the like. The invention is not limited to any particular kind of stored gases and/or liquids.

In accordance with a further aspect of the invention, a vessel as described hereinabove, which is manufactured in particular according to a method according to the invention, can be used for different purposes.

Examples of possible types of application are, for example and not exclusively, use as a pressure vessel for combustible gases such as, for example, natural gas or hydrogen, for gas-powered vehicles, pressure vessels for pneumatic and hydraulic applications, compressed air storage in heavy good vehicles, buses and railways, as pressure vessels for fire extinguishers, as pressure vessels for safety systems (for example, airbags), and as pressure vessels for propane gas.

BRIEF DESCRIPTION OF THE DRAWINGS

The invention will hereinafter be described in more detail with reference to embodiments and to the attached drawings, wherein there is shown, in.

DETAILED DESCRIPTION OF THE INVENTION

Figure 1:
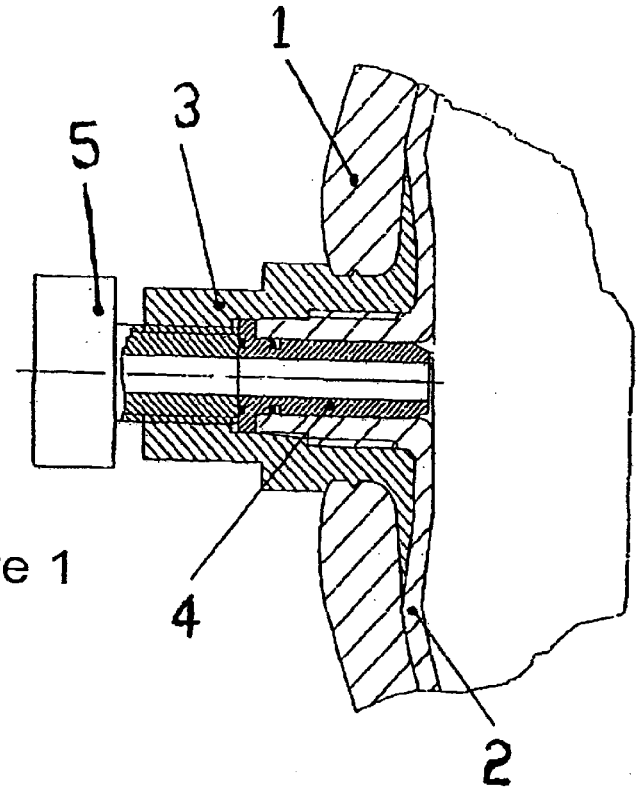
FIG. 1 a schematic cross-section of the connector area according to the invention, FIG. 2 a schematic plan view of the vessel according to the invention according to a second embodiment with centrally arranged filling and emptying apertures in a lid, FIG. 3 a schematic plan view of the vessel according to the invention according to a third embodiment with two filling and emptying apertures arranged offset in the lid, FIG. 4 a schematic side view of the vessel according to the invention of FIGS. 1–3, with a filling and emptying aperture arranged optionally in addition in the cylindrical part of the vessel.

In FIG. 1 the connector area of one embodiment is shown schematically in cross-section. On the fibre plastics composite (1) reinforced plastics core vessel (2) for storage of liquid and/or gaseous media under pressure there is fitted a connection piece (3) in the neck and/or base and/or cylindrical part of the container.

An insert (4) is provided in the connection piece (3) of the plastics core vessel (2), which insert clads the outlet of the connector shank of the plastics core vessel (2) in the manner of a collar.

The insert (4) can be provided with an annular groove for a sealing ring beneath the projecting collar of the insert (4) between the insert and the internal surface of the connector shank of the plastics core vessel (2) as well as a further annular groove with a sealing ring on the surface of the projecting collar of the insert, that is compressed by the pressure hose feed (5) (pipeline connector and/or valve). In addition by means of previous processing or other suitable manufacturing of the connector shank, the internal surface of the connector shank of the plastics core vessel can be joined, for example by shrinkage, onto the insert, resulting in great dimensional precision of the external geometry of the connector shank of the plastics core vessel.

The connection piece (3) is collar-shaped with respect to the surface of the plastics core vessel (2), configured with or without raised areas arranged on the surface of the collar, and/or keyed surfaces offset by 90° on the external surface of the connection piece in the region of the fibre plastics composite (1). This configuration of the connection piece enables specific transfer of force from the fibre plastics composite (1) to the connection piece (3) and resistance to twisting during assembly and disassembly of the pipeline connection or a valve.

Figure 2:
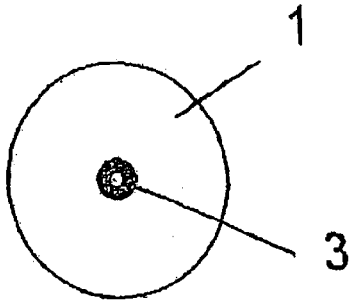

In FIG. 2 a schematic plan view of the vessel according to the invention is shown in accordance with an embodiment, wherein the vessel can be filled and/or emptied via the centrally arranged connection piece (3).

Figure 3:
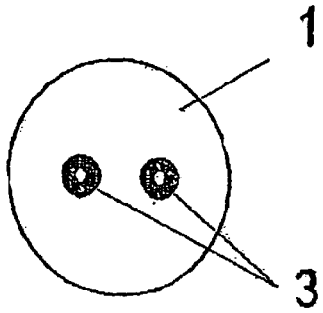

In FIG. 3 a schematic plan view of the vessel according to the invention is shown in accordance with a further embodiment, wherein the vessel can be filled and/or emptied via two offset connection pieces (3).

Figure 4:
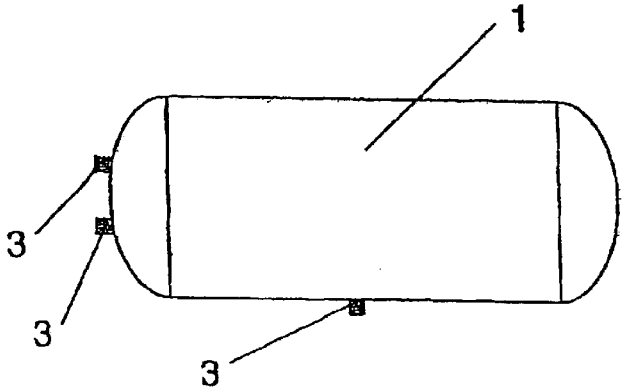

FIG. 4 shows, by way of an example, an optional configuration of FIG. 2 and FIG. 3 where, for technical reasons, a further connector (3) has to be arranged in the cylindrical part of the vessel.

Having thus described the invention of the present application in detail and by reference to preferred embodiments thereof, it will be apparent that modifications and variations are possible without departing from the scope of the invention defined in the application claims.

What is claimed is:

1. Fibre plastics composite reinforced plastics core vessel for storage of liquid and/or gaseous media under pressure comprising:

a plastics core vessel defining at least one connector shank in communication with said vessel;

a cylindrical insert mounted in said connector shank of said vessel, said insert having a collar-shaped end that overlays the end of said connector shank and defining at least two seals arranged such that at least one seal is positioned between said insert and an internal surface of said connector shank, and at least one seal is positioned in a surface of said collar-shaped end of said insert; and one or more connection pieces connected to said vessel, at least one of said connection pieces being connected to said connector shank extending axially outward beyond said insert and radially inward over an outer portion of said collar-shaped end of said insert and being configured to receive a pressure hose feed, said at least one seal positioned in a surface of said collar-shaped end of said insert being engaged by a pressure hose feed when received in said connection piece.

2. Fibre plastics composite reinforced plastics core vessel according to claim 1 wherein said seal between said insert and said internal surface of said connector shank of said plastics core vessel and/or said seal between said collar-shaped end surface of said insert and a pressure hose feed received in said connection piece comprises annular grooves together with a seal and/or another suitable sealing means or a gasket.

3. Fibre plastics composite reinforced plastics core vessel according to claim 1 wherein said connection piece has a collar surface matched to the contour of said connector shank of said plastics core vessel, said collar surface being adapted to be firmly fixed to said connector shank of said plastics core vessel using suitable fastening techniques.

4. Fibre plastics composite reinforced plastics core vessel according to claim 1 wherein said connection piece is connected by a threaded portion, and/or adhesive, and/or other fastening techniques to an external surface of said connector shank of said plastics core vessel, and/or to a portion of an external surface of said collar-shaped end of said insert.

5. Fibre plastics composite reinforced plastics core vessel according to claim 1 wherein said connection piece is provided with a conical or cylindncal internal thread for receiving a pressure hose feed.

6. Fibre plastics composite reinforced plastics core vessel according to claim 1 wherein fibre plastics composite can be incorporated into cylindrical recesses of said connection piece, raised parts or indentations on a surface of a collar of said connection piece and/or keyed surfaces on said connection piece in the region of the fibre plastics composite produce a higher resistance to torsion for said connection piece.

7. Fibre plastics composite reinforced plastics core vessel according to claim 2 wherein said connection piece has a collar surface matched to the contour of said connector shank of said plastics core vessel, said collar surface being adapted to be firmly fixed to said connector shank of said plastics core vessel using suitable fastening techniques.

8. Fibre plastics composite reinforced plastics core vessel according to claim 2 wherein said connection piece is connected by a threaded portion, and/or adhesive, and/or other fastening techniques to an external surface of said connector shank of said plastics core vessel, and/or to a portion of an external surface of said collar-shaped end of said insert.

9. Fibre plastics composite reinforced plastics core vessel according to claim 3 wherein said connection piece is connected by a threaded portion, and/or adhesive, and/or other fastening techniques to an external surface of said connector shank of said plastics core vessel, and/or to a portion of an external surface of said collar-shaped end of said insert.

10. Fibre plastics composite reinforced plastics core vessel according to claim 2 wherein said connection piece is provided with a conical or cylindrical internal thread for receiving the pressure hose feed.

11. Fibre plastics composite reinforced plastics core vessel according to claim 3 wherein said connection piece is provided with a conical or cylindrical internal thread for receiving the pressure hose feed.

12. Fibre plastics composite reinforced plastics core vessel according to claim 4 wherein said connection piece is provided with a conical or cylindrical internal thread for receiving the pressure hose feed.

13. Fibre plastics composite reinforced plastics core vessel according to claim 2 wherein fibre plastics composite can be incorporated into cylindrical recesses of said connection piece, raised parts or indentations on a surface of a collar of said connection piece and/or keyed surfaces on said connection piece in the region of the fibre plastics composite produce a higher resistance to torsion for said connection piece.

14. Fibre plastics composite reinforced plastic core vessel according to claim 3 wherein fibre plastics composite can be incorporated into cylindrical recesses of said connection pieces, raised parts or indentations on a surface of a collar of said connection piece and/or keyed surfaces on said connection piece in the region of the fibre plastics composite produce a higher resistance to torsion for said connection piece.

15. Fibre plastics composite reinforced plastics core vessel according to claim 4 wherein fibre plastics composite can be incorporated into cylindrical recesses of said connection pieces, raised parts or indentations on a surface of a collar of said connection piece and/or keyed surfaces on said connection piece in the region of the fibre plastics composite produce a higher resistance to torsion for said connection piece.

16. Fibre plastics composite reinforced plastics core vessel according to claim 5 wherein fibre plastics composite can be incorporated into cylindrical recesses of said connection pieces, raised parts or indentations on a surface of a collar of said connection piece and/or keyed surfaces on said connection piece in the region of the fibre plastics composite produce a higher resistance to torsion for said connection piece.

* * * * *